US006565306B2

(12) United States Patent
Fliegel et al.

(10) Patent No.: US 6,565,306 B2
(45) Date of Patent: May 20, 2003

(54) METHOD OF AND APPARATUS FOR AUTOMATICALLY OPENING AND EMPTYING CONTAINERS FOR ARRAYS OF ROD-SHAPED COMMODITIES

(75) Inventors: Richard Fliegel, Glinde (DE); Thomas Janthur, Hamburg (DE); Recep Kaya, Hamburg (DE)

(73) Assignee: Hauni Maschinenbau Aktiengesellschaft, Hamburg (DE)

( * ) Notice: Subject to any disclaimer, the term of this patent is extended or adjusted under 35 U.S.C. 154(b) by 0 days.

(21) Appl. No.: 09/761,832

(22) Filed: Jan. 18, 2001

(65) Prior Publication Data

US 2001/0008242 A1 Jul. 19, 2001

(30) Foreign Application Priority Data

Jan. 19, 2000 (DE) ..... 100 02 190

(51) Int. Cl.[7] ..... B65B 69/00
(52) U.S. Cl. ..... 414/411; 414/810; 414/416.05
(58) Field of Search ..... 414/411, 416.05, 414/412, 403, 786, 810

(56) References Cited

U.S. PATENT DOCUMENTS

| | | | | | |
|---|---|---|---|---|---|
| 3,655,080 | A | * | 4/1972 | Gianese | 414/403 |
| 3,774,791 | A | | 11/1973 | Bornfleth | |
| 3,783,752 | A | * | 1/1974 | Langen et al. | 493/18 |
| 4,403,908 | A | * | 9/1983 | Cartoceti | 414/403 |
| 4,412,505 | A | | 11/1983 | Häusler et al. | |
| 4,537,587 | A | * | 8/1985 | Langen | 493/315 |
| 4,541,521 | A | * | 9/1985 | Menge | 198/463.5 |
| 4,575,301 | A | * | 3/1986 | Lodi et al. | 414/411 |
| 4,661,034 | A | | 4/1987 | Kumata et al. | |
| 4,696,617 | A | * | 9/1987 | Kumata et al. | 414/422 |
| 4,843,801 | A | * | 7/1989 | Roncero | 414/411 |
| 5,106,254 | A | * | 4/1992 | Tolasch et al. | 414/403 |
| 5,135,008 | A | | 8/1992 | Oesterling et al. | |
| 6,152,279 | A | * | 11/2000 | Davis | 198/323 |
| 6,240,707 | B1 | * | 6/2001 | Ford et al. | 493/315 |

FOREIGN PATENT DOCUMENTS

| | | | |
|---|---|---|---|
| JP | 57-28640 | 6/1957 | |
| JP | 56-52880 | 12/1981 | |
| JP | 56-52880 | * 12/1989 | A25C/5/52 |

* cited by examiner

*Primary Examiner*—Dean J. Kramer
*Assistant Examiner*—Charles A. Fox
(74) *Attorney, Agent, or Firm*—Venable LLP; Robert Kinberg; Chad C. Anderson

(57) ABSTRACT

A series of successive filled and closed containers for filter rod sections or other products of the tobacco processing industry is advanced stepwise along a horizontal path. When the foremost container of the series reaches a given portion of the path, it is moved forwardly and away from the next-following container into the cage of an elevator. The foremost container is opened while in or at the cage, and the cage is thereupon lifted to a level at which the opened container therein can be tilted to dump its contents into a chute, a magazine of the like. The thus emptied container is thereupon tilted back to its original orientation and is transported away to a dump, to a recycling station or to a refilling station. All of the above-enumerated undertakings are carried out automatically. The next-following container, i.e., the foremost container of the remainder of the series, is thereupon manipulated in the same way as the aforementioned foremost container, and so forth.

23 Claims, 8 Drawing Sheets

METHOD OF AND APPARATUS FOR AUTOMATICALLY OPENING AND EMPTYING CONTAINERS FOR ARRAYS OF ROD-SHAPED COMMODITIES

CROSS-REFERENCE TO RELATED CASES

The present application claims the priority of commonly owned German patent application Serial No. 100 02 190.5 filed Jan. 19, 2000. The disclosure of the above-referenced German patent application, as well as that of each U.S. and foreign patent and patent application identified in the specification of the present application, is incorporated herein by reference.

BACKGROUND OF THE INVENTION

The invention relates to improvements in methods of and in apparatus for manipulating closed and filled containers, and more particularly to improvements in methods of and in apparatus for automatically opening and emptying originally closed and at least partially filled containers, such as boxes, crates, cartons or the like, for arrays or other types of accumulations of discrete commodities. Examples of such commodities are filter rod sections, plain or filter cigarettes, cigars, cigarillos and/or other rod-shaped products of the tobacco processing industry.

Published Japanese patent applications Serial Nos. 56-52880 and 57-28640 disclose apparatus wherein opened cardboard boxes for piles or similar accumulations of parallel filter rod sections are placed onto a conveyor for delivery to an elevator. The latter lifts successive cartons into a pivotable dumping frame. The frame is pivoted upon receipt of an opened and still filled carton so that the contents of the carton are discharged by gravity flow. The freshly emptied carton is discharged from the frame, while it still remains in inverted position, and is caused to lie on a takeoff conveyor, such as a chute or slide, which transports the emptied carton to a selected destination.

A drawback of the above outlined prior proposals is that the manipulation of cartons takes up relatively long periods of time. This is attributable, in part, to the fact that the cartons must be opened at one or more locations ahead of the aforementioned conveyor and also to the fact that the evacuation of emptied cartons is complex, time-consuming and must be carried out in a relatively large part of a mass-producing plant.

OBJECTS OF THE INVENTION

An object of the invention is to provide a method which can be utilized to reliably and predictably evacuate the contents of successive filled and initially closed containers for rod-shaped smokers' products and the like in a time-saving manner and in a fully automatic way, i.e., without the need for any or for appreciable manual intervention.

Another object of the invention is to provide a method which involves opening and expulsion of the contents of standard boxes, cartons, crates and analogous containers.

A further object of the invention is to provide a method which can be practiced without necessitating any, or any appreciable periods of monitoring, adjusting or other personnel-involving manipulation of containers for rod-shaped smokers' products or the like.

An additional object of the invention is to provide a novel and improved method of converting discrete arrays and/or other groupings of commodities into a single mass flow or another suitable accumulation of the contents of containers for rod-shaped or other types of products.

A further object of the invention is to provide a method which renders it possible to empty the contents of initially closed and filled containers at a high frequency, in a small area and by resorting to a relatively simple, compact and inexpensive but reliable and long-lasting equipment.

Still another object of the invention is to provide an automatic apparatus for the manipulation of closed and filled containers for rod-shaped smokers' products and the like.

A further object of the invention is to provide an apparatus which can be readily installed in or combined with existing machines and/or production lines for the making and processing of cigarettes or other smokers' products.

Another object of the invention is to provide the above outlined apparatus with novel and improved means for opening, transporting, emptying and disposing of containers for arrays of rod-shaped products or the like.

An additional object of the invention is to provide a novel and improved combination of facilities for singularizing, opening, transporting and dumping the contents of and evacuating emptied containers for commodities, especially rod-shaped products of the tobacco processing industry.

Still another object of the invention is to provide an apparatus which exhibits the above-enumerated features and advantages and can be utilized for the manipulation of existing types of containers for arrays or other types of accumulations of rod-shaped or other commodities.

A further object of the invention is to provide a machine or a production line which embodies or cooperates with one or more apparatus of the above outlined character.

SUMMARY OF THE INVENTION

One feature of the present invention resides in the provision of a method of automatically manipulating closed-top filled containers (such as boxes, cartons or the like) for rod-shaped articles, e.g., for filter rod sections or other rod-shaped products of the tobacco processing industry. The improved method comprises the steps of opening the top of a container, thereupon moving the container from a first level to a second level (preferably from a lower level to a higher level), and thereupon causing the container to change its orientation from a first orientation in which the products: are located beneath the opened top to a second orientation in which the products are evacuated through the opened top by gravity flow.

The orientation changing step can include turning the container upside down, particularly inverting the container about a horizontal or substantially horizontal axis through an angle matching or close to 180°.

The method preferably further comprises the steps of causing the inverted or upturned and thus emptied container to reassume its first orientation (or an orientation close to the first orientation), and thereupon advancing the container along a predetermined paths e.g., to a refilling or to a material reprocessing station. Such method preferably comprises the step of compelling the reoriented container to retain its orientation in the course of the advancing step, i.e., during movement along the predetermined path. The reassuming step can include causing the emptied container to pivot through an angle of at least close to 180° so that the opened cover or top is again located at or close to the upper end of the emptied container.

The containers are preferably (or can be) constructed and assembled in such a way that each thereof comprises upright sidewalls (e.g., four sidewalls) and a cover (this cover constitutes the aforementioned top) which is connected to one of the sidewalls and is pivotable between closed and open positions. The cover carries flaps which are movable relative to the cover between first positions preferably inwardly adjacent to additional sidewalls of the container in the closed position of the cover and second positions upon pivoting of the cover to its open position. The aforementioned step of opening a container of the just outlined character can include pivoting the cover from the closed to the open position, and thereupon moving the flaps relative to the cover. The flaps are or can be pivotable relative to the cover, and the step of moving the flaps can include pivoting the flaps relative to the cover through angles which at least approximate 180°.

Another feature of the invention resides in the provision of a method of automatically (as contrasted with manually) manipulating filled closed-top containers for various commodities, such as rod-shaped smokers' products. This method comprises the steps of advancing a series of successive filled upright closed-top containers in a predetermined direction along a predetermined path (e.g., along an at least substantially horizontal path) wherein successive foremost containers are located ahead of the other containers of the series (such other containers can form a column of abutting containers), singularizing the series including moving successive foremost containers into a predetermined portion of the predetermined path, opening the tops of successive foremost containers in the predetermined portion of the path, thereupon moving successive containers from the predetermined portion of the path (such containers are still filled but their tops are open), and thereupon causing successive containers to change their orientation from a first orientation in which the products are located below the respective opened tops to a second orientation in which the products can be evacuated through the respective opened tops, preferably by gravity flow.

The moving step of the just described method can include changing the levels of successive containers, e.g., from a lower level to a higher level.

The orientation changing step can include turning the containers upside down, e.g., by pivoting them about an at least substantially horizontal axis through an angle of 180° or close to 180°.

A further feature of the instant invention resides in the provision of an apparatus for automatically manipulating initially closed-top containers for commodities, e.g., parallel rod-shaped smokers' products. The apparatus comprises means (such as a belt, band or chain conveyor) for advancing successive filled closed-top containers in a predetermined direction along a predetermined path, and means for opening selected (preferably successive) containers of the series in a predetermined portion of the path.

The opening means can comprise at least one suction generating device (e.g., a set of suction cups).

The containers can be of the type wherein a cover (constituting the top of the container) is pivotable relative to one of several normally upright sidewalls; the at least one suction generating device of the means for opening such containers can include means for pivoting the cover or top of the container in the predetermined portion of the path relative to the one sidewall from a closed position to an open position. The apparatus can further comprise means for temporarily holding or maintaining in open position the cover or top of the container which occupies the predetermined portion of the path. Such holding means can comprise one or more resilient members, e.g., resilient metallic members.

The covers of the containers are or can be provided with pivotable flaps which engage additional sidewalls of the respective containers prior to opening of the respective covers or tops. The flaps are disengaged from the additional sidewalls when the cover or top is pivoted from the closed to the open position, and the apparatus for manipulating such containers preferably further comprises displacing means serving to move at least one flap of the cover or top assuming the open position relative to the cover while the respective container still occupies the predetermined portion of the path. The displacing means can include means for pivoting the at least one flap relative to the respective cover or top away from the sidewalls of the container occupying the predetermined portion of the path.

The apparatus can further comprise a suitable elevator having at least one receptacle (such as a cage) movable between a first level at which it at least partially confines the open-top container occupying the predetermined portion of the path and a different second level. The second level is or can be disposed above the first level, and the apparatus can further comprise emptying means for changing the orientation of the opened (open top) container at the second level from a first orientation in which the opened container confines the products and a second orientation in which the container can dump its contents by gravity flow. Still further, such apparatus can include means for restoring the first orientation of emptied containers, and means for thereupon transporting freshly emptied containers along a second path (e.g., along a horizontal or nearly horizontal path at a level above and parallel or substantially parallel to the predetermined path). Still further, such apparatus can comprise means for preventing appreciable changes in orientation of emptied containers in the second path; such preventing means can include at least one brake, and the at least one brake can include at least one brush which frictionally engages emptied containers in the second path.

The opening means is preferably arranged to open the container occupying the predetermined portion of the predetermined path subsequent to confinement of the container in the at least one receptacle of the elevator.

The apparatus can further comprise guide means for the container which is confined in the at least one receptacle of the elevator; such guide means is operative to maintain the container which is confined in the receptacle in a predetermined position during movement of the at least one receptacle from the first level to the second level.

As already mentioned hereinbefore, the means for advancing the containers along the predetermined path can comprise a conveyor for successive containers of the series, and such advancing means can further comprise means for maintaining the containers of the series in the predetermined path and means for separating successive foremost containers from the next-following containers in a second portion of the path which is located upstream of the predetermined portion (as seen in the predetermined direction). The separating means can include suction-operated means for temporarily arresting successive next-following containers in the second portion of the path while the conveyor advances the foremost container into the predetermined portion of the path, preferably directly into the aforementioned at least one receptacle of the elevator.

The novel features which are considered as characteristic of the invention are set forth in particular in the appended claims. The improved apparatus itself, however, both as to its construction and the modes of assembling and utilizing the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
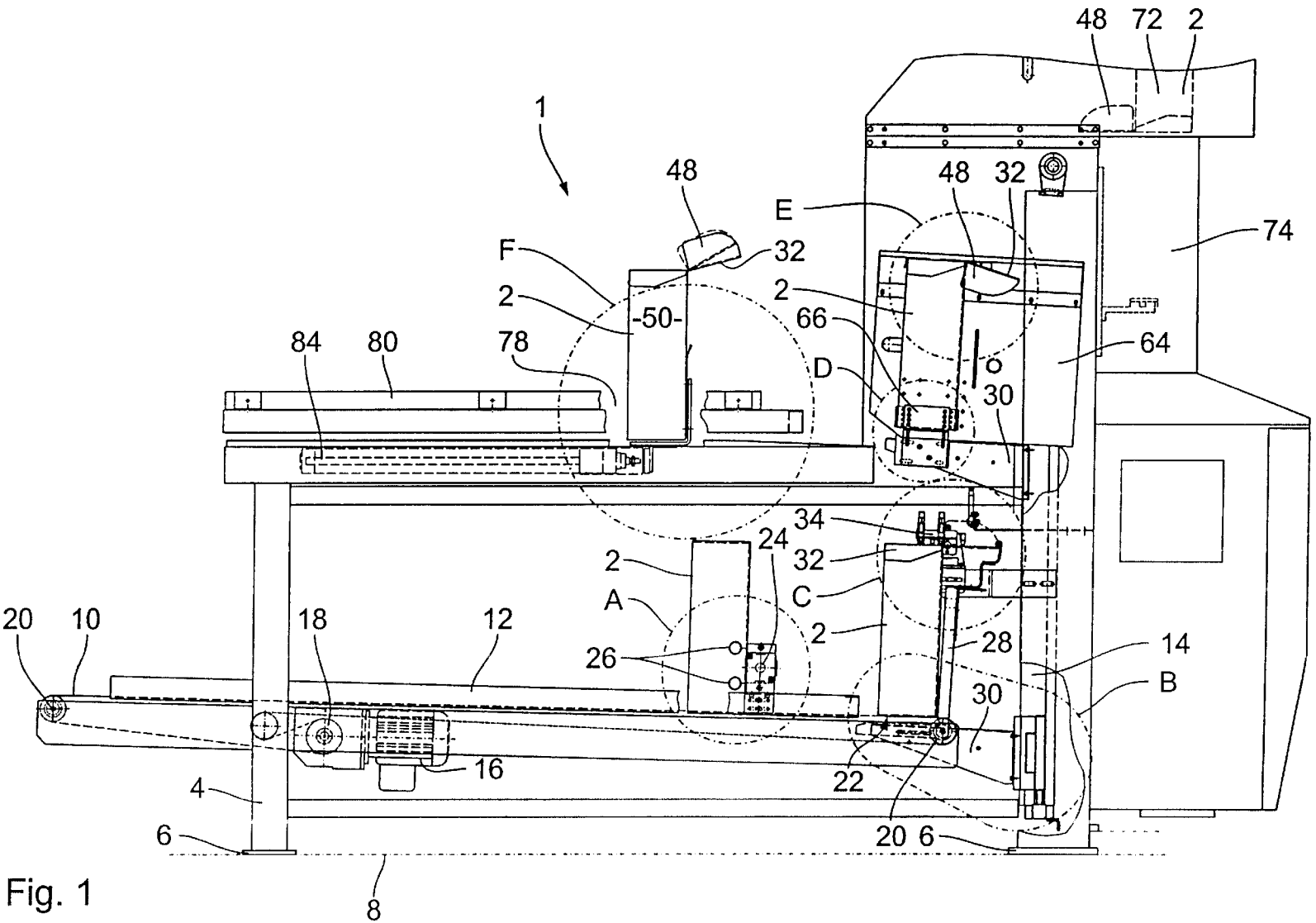
FIG. 1 is a somewhat schematic side elevational view of an apparatus which embodies one presently preferred form of the invention, certain constituents of the apparatus being shown partly broken away to reveal parts which are located therebehind.
Figure 2:
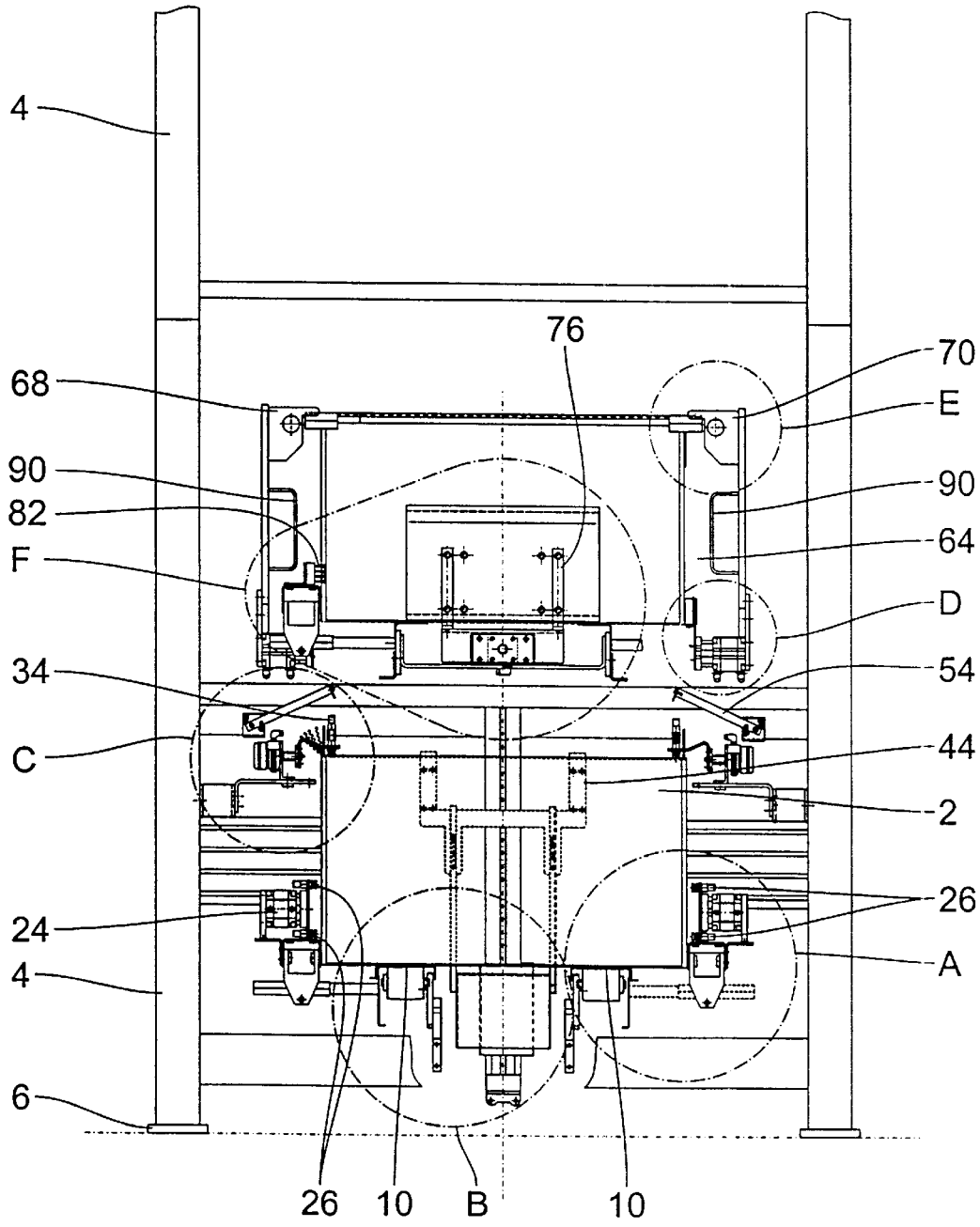
FIG. 2 is a somewhat schematic front elevational view of the apparatus as seen from the left-hand side of FIG. 12.

The apparatus 1 which is shown in FIGS. 1 and 2 serves to automatically open closed and filled containers 2, 2*a*, 2*b*, 2*c*, 2*d* . . . , and more specifically successive foremost filled and closed containers of a series of successive containers of which only the five foremost containers 2 to 2*d* are shown in FIG. 1. These containers are advanced in the (predetermined) direction of arrow 10*a* by an advancing means including an endless belt, band or chain conveyor 10 (hereinafter called conveyor or belt conveyor).

FIG. 1 shows the foremost container 2 of the series in a receptacle or cage 22 of an elevator 14. This container is spaced apart from the next-following container 2*a* but the containers 2*a*, 2*b*, 2*c*, 2*d* (and the containers following the container 2*d*) preferably abut each other side-by-side to form a normally uninterrupted file of contacting containers. The illustrated conveyor 10 defines a predetermined horizontal or substantially horizontal path for the containers 2*a* to 2*d* and the next-following filled and closed containers, and this conveyor cooperates with lateral guides 12 to confine the filled containers to movement along the predetermined path, The filled container 2 in the receptacle 22 of the elevator 14 occupies a predetermined first portion of the horizontal path, and the next-following container 2*a* occupies a second portion of such path behind (upstream of) and spaced apart from the first portion The conveyor 10 includes two endless belts 10*b*, 10*c* (see FIG. 2) which are mounted in two parallel vertical planes and are spaced apart from each other as seen transversely of the direction indicated by the arrow 10*a*. This conveyor is mounted in a frame or housing 4 having legs 6 which rest upon the floor 8 in a cigarette making plant or the like. For example, the apparatus 1 can be set up to deliver filter rod sections of desired length (e.g., multiple unit length) to a filter tipping machine wherein discrete filter rod sections of double unit length are united with pairs of plain cigarettes of unit length to form therewith filter cigarettes of double unit length. Reference may be had, for example, to commonly owned U.S. Pat. No. 5,135,008 granted Aug. 4, 1992 to Oesterling et al. for "METHOD OF AND APPARATUS FOR MAKING FILTER CIGARETTES". A tipping machine which serves to assemble pairs of plain cigarettes of unit length with filter rod sections of double unit length is known as MAX and is distributed by the assignee of the present application.

Filter rod sections which are confined in the containers 2 to 2*d* can be of the type turned out by so-called KDF machines which, too, are distributed by the assignee of the present application. Reference may be had, for example, to U.S. Pat. No. 4,412,505 granted Nov. 1, 1983 to Häusler et al. for "APPARATUS FOR APPLYING ATOMIZED LIQUID TO A RUNNING LAYER OF FILAMENTARY MATERIAL OR THE LIKE"; this patent describes and illustrates a filter rod making machine which can supply filter rod sections of selected length to a packing or crating or cartoning or boxing machine serving to supply containers 2 to 2*d* and additional filled containers to the receiving end of the conveyor 10.

FIG. 1 further shows a prime mover 16 (e.g., an electric stepping motor) which transmits torque to a driver pulley 18 for the endless belts 10*b*, 10*c* of the conveyor 10. These belts are further trained over idler pulleys 20.

The reference character 25 denotes in FIG. 1 an optical or other suitable sensor which transmits signals for actuation of a suction-operated singularizing device 24 when the foremost container 2 advances beyond that (second) portion of the path defined by the conveyor 10 which, in FIG. 1, is occupied by the next-following filled container 2*a*. Such signal from the sensor 25 causes the suction cups 26 of the two-part singularizing device 24 to attract the adjacent upright sidewalls 2C, 2D of the container 2*a* for an interval of time which suffices to advance the foremost container 2 from the locus of the sensor 25 toward and into the receptacle 22 of the elevator 14; this receptacle is then located at a lower level, namely at a level to properly receive the container 2 being advanced by the upper reaches of the belts 10*b*, 10*c*.

Figure 3B:
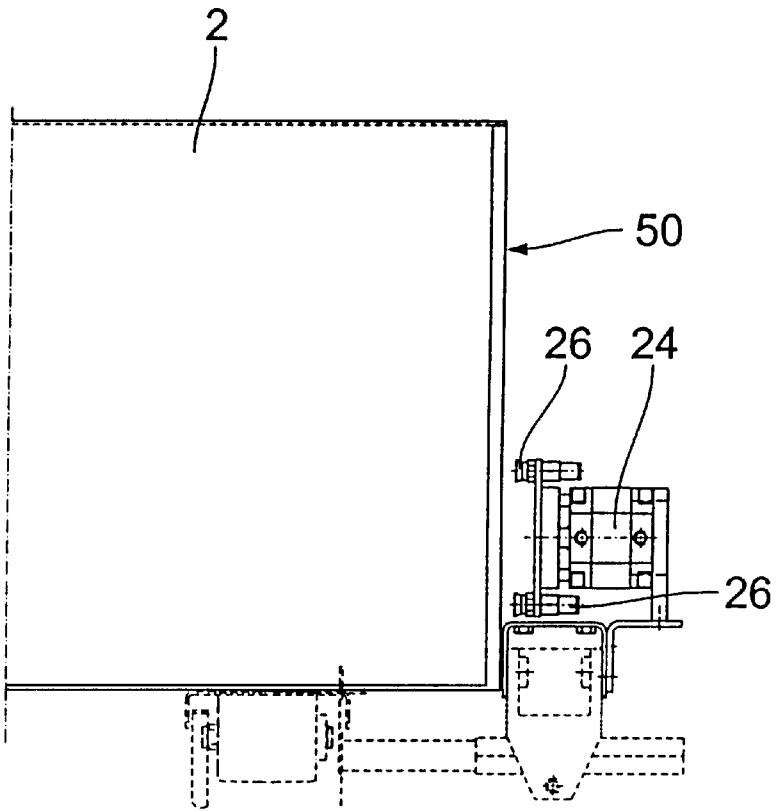
FIG. 3*b* is an enlarged view of a detail, namely a singularizing device, within the dot-dash line A' in FIG. 2.
Figure 3A:
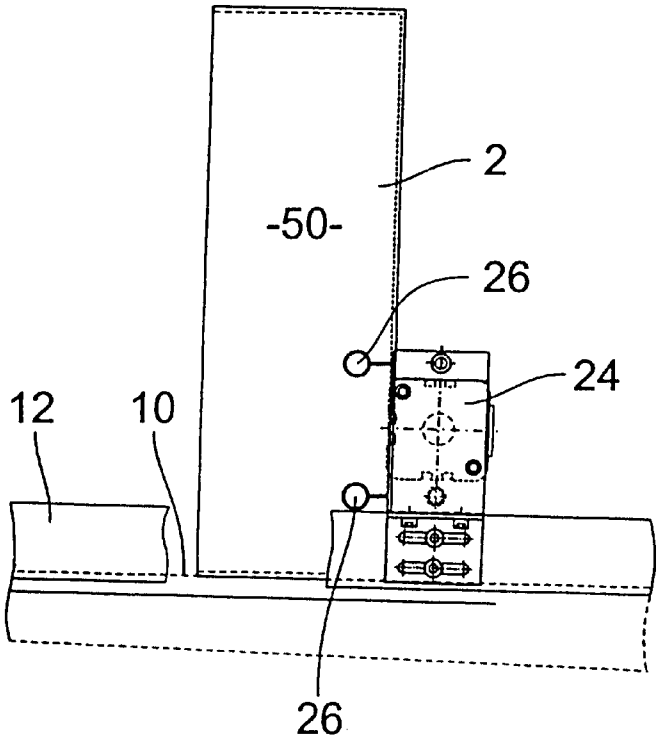
FIG. 3*a* is an enlarged view of a detail, namely of a portion of the container singularizing device, within a dot-dash line circle A shown in FIG. 1.

The suction cups 26 of the singularizing device 24 are preferably movable transversely of the belts 10*b*, 10*c* toward and away from the container 2*a* then located immediately upstream of the region being monitored by the sensor 25. Reference may be had to FIGS. 3*a* and 3*b* which show, on a greatly enlarged scale, certain details within the dot-dash line circle A of FIG. 1 and within the dot-dash line circle A' of FIG. 2. A portion of one lateral guide 12 is broken away in FIG. 1 to show the locus of one-half of the singularizing device 24 at one side of the predetermined path defined by the upper reaches of the belts 10*b*, 10*c* for the closed and filled containers 2 to 2*d*, etc. The means (not shown) for moving the suction cups 26 toward and away from the adjacent sidewalls 2C, 2D of the container 2*a* shown in FIG. 1 can include magnets or any other devices which respond to signals transmitted by the sensor 25. FIG. 3*a* shows the container 2*a* and one-half of the singularizing device 24 in a view as seen in FIG. 1, and FIG. 3*b* shows a portion of the container 2*a* and one-half of the device 24 in a view as seen in FIG. 2.

Figure 4B:
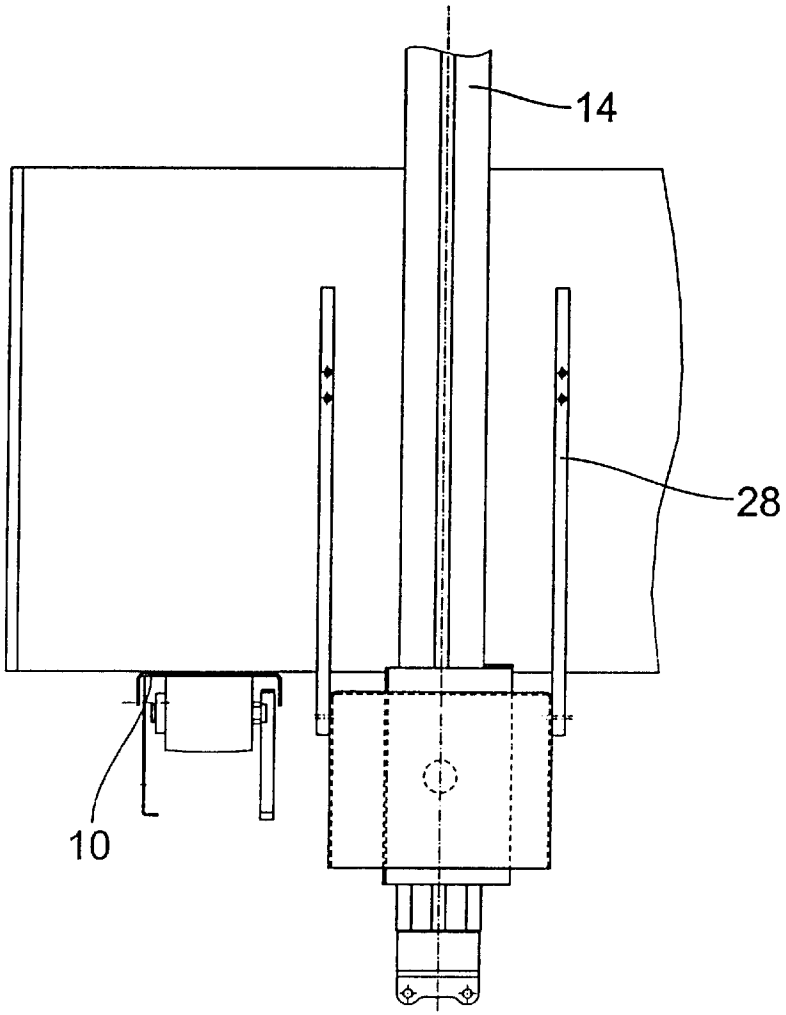
FIG. 4*b* is an enlarged view of a detail of the elevator within the dot-dash line circle B' shown in FIG. 2.
Figure 4A:
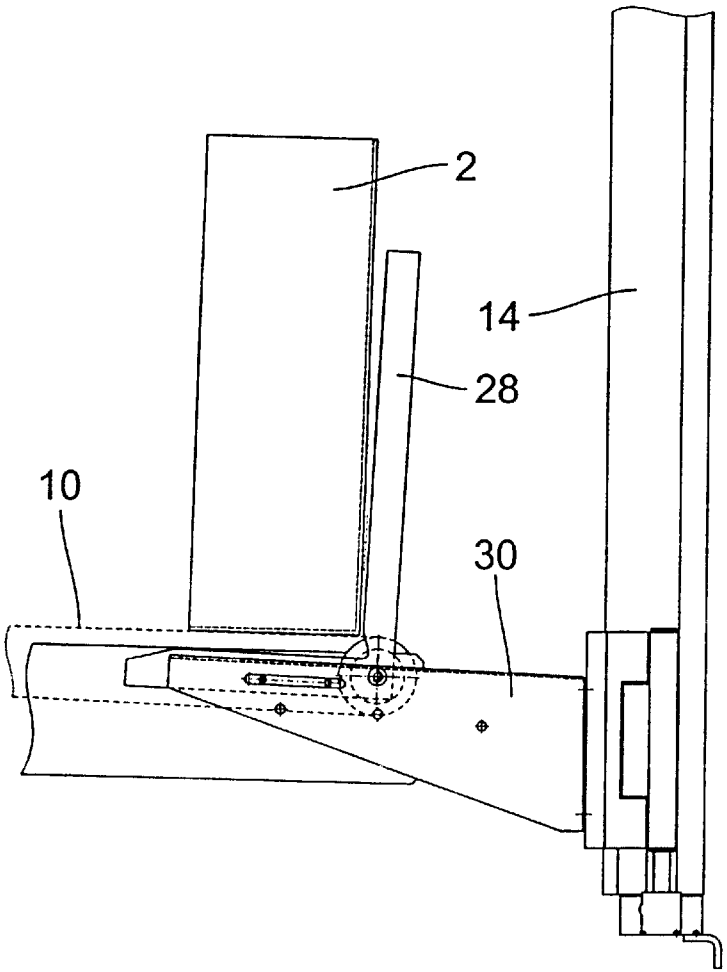
FIG. 4*a* is an enlarged view of a detail, namely of a portion of the elevator, within the closed dot-dash line B shown in FIG. 1.

The container 2 is properly confined in the receptacle 22 of the elevator 14 when it abuts a plate-like stop 28 of the elevator. As already mentioned hereinbefore, the conveyor 10 has two endless flexible belts 10*b*, 10*c* which are spaced apart to provide room for a horizontal lifting arm 30 forming part of the elevator 14 and serving to lift the container 2 oft the upper reaches of the belts 10*b*, 10*c* so that the container 2 can share the upward movement of the receptacle 22 from the lower level shown in FIGS. 4*a* and 4*b*. The thus lifted receptacle 22 maintains the container 2', which has preceded the container 2 in proper position for evacuation of its contents into a magazine 74, into a chute or into any other suitable device or unit capable of storing and/or conveying the evacuated contents to the next processing station, e.g., into the magazine of a tipping machine of the type described in the aforementioned U.S. Pat. No. 5,135,008 to Oesterling et al.

Figure 5B:
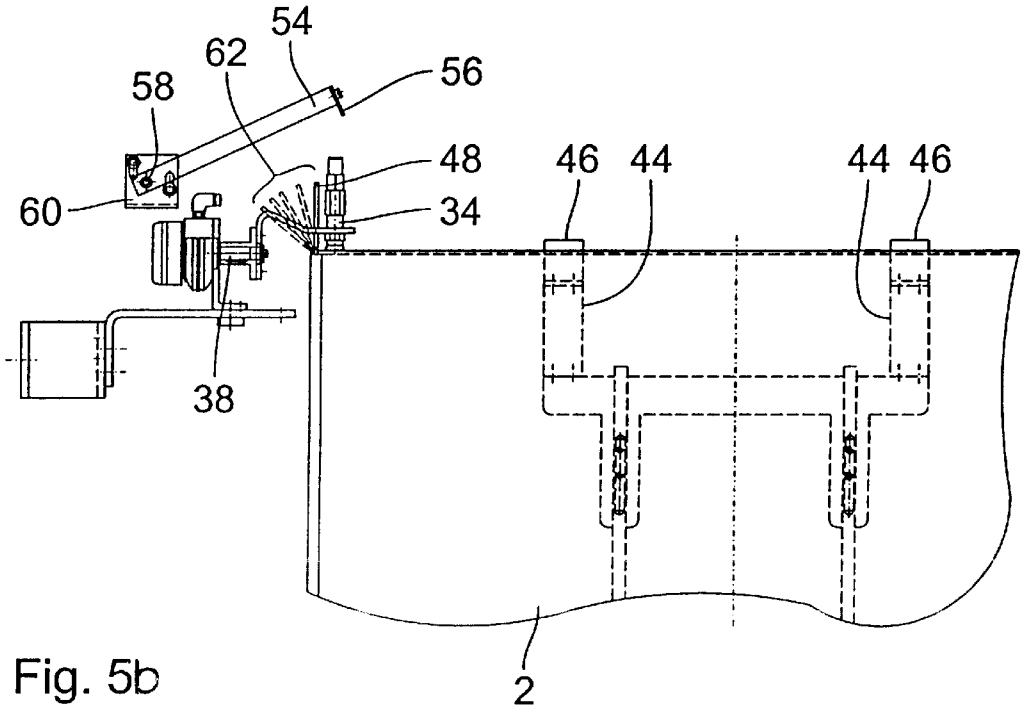
FIG. 5*b* is an enlarged view of a detail of the opening means within the dot-dash line circle C' shown in FIG. 2.
Figure 5A:
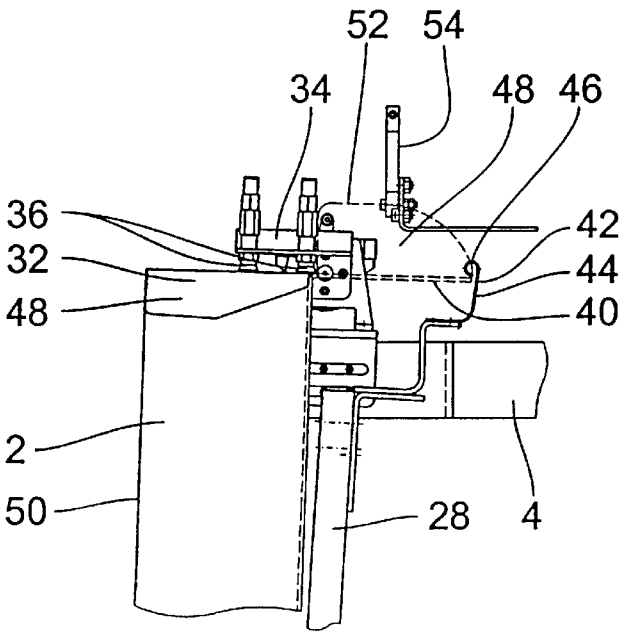
FIG. 5*a* is an enlarged view of a detail, namely of the container opening means, within the dot-dash line circle C shown in FIG. 1.
Figure 6B:
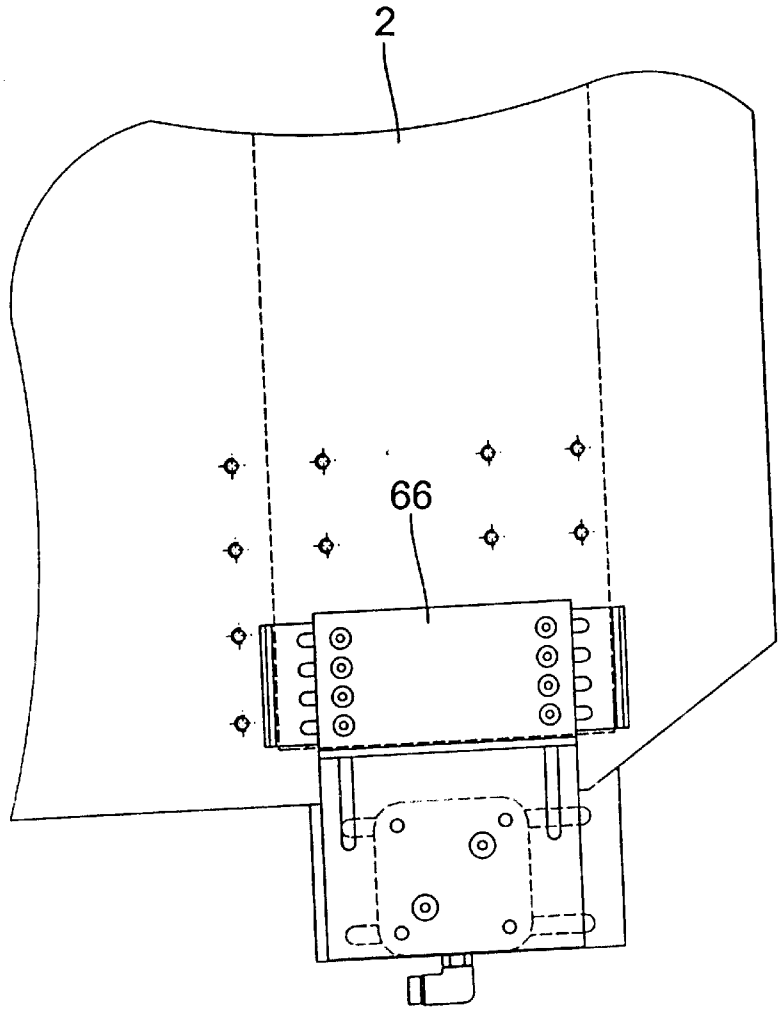
FIG. 6*b* is an enlarged view of a detail of the container emptying means within the dot-dash line circle D' shown in FIG. 2.
Figure 6A:
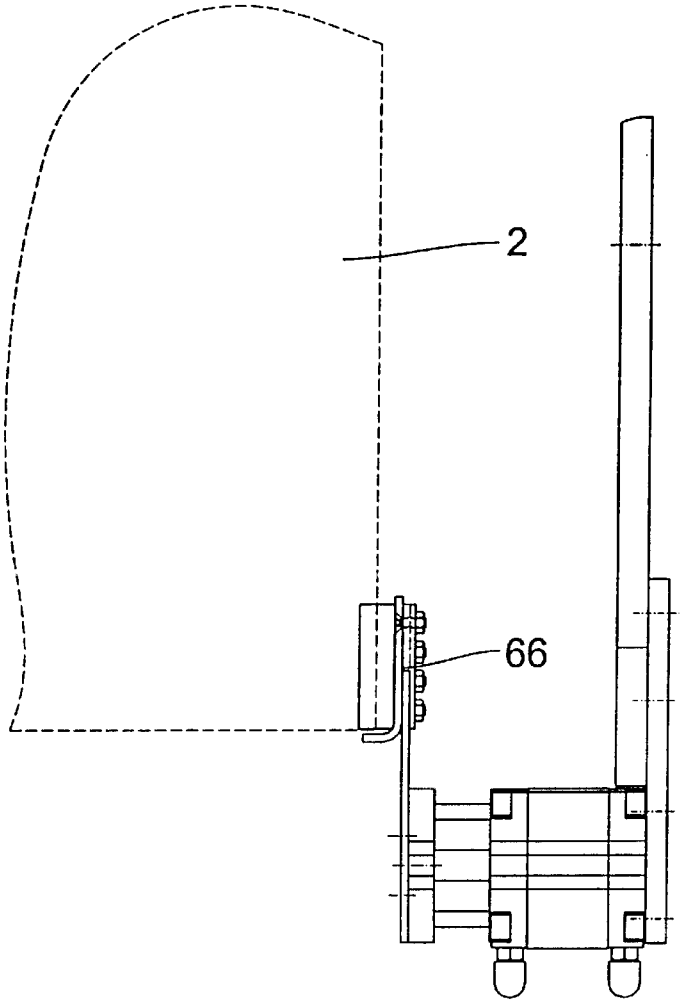
FIG. 6*a* is an enlarged view of a detail, namely of a portion of the container emptying means, within the dot-dash line circle D shown in FIG. 1.
Figure 7B:
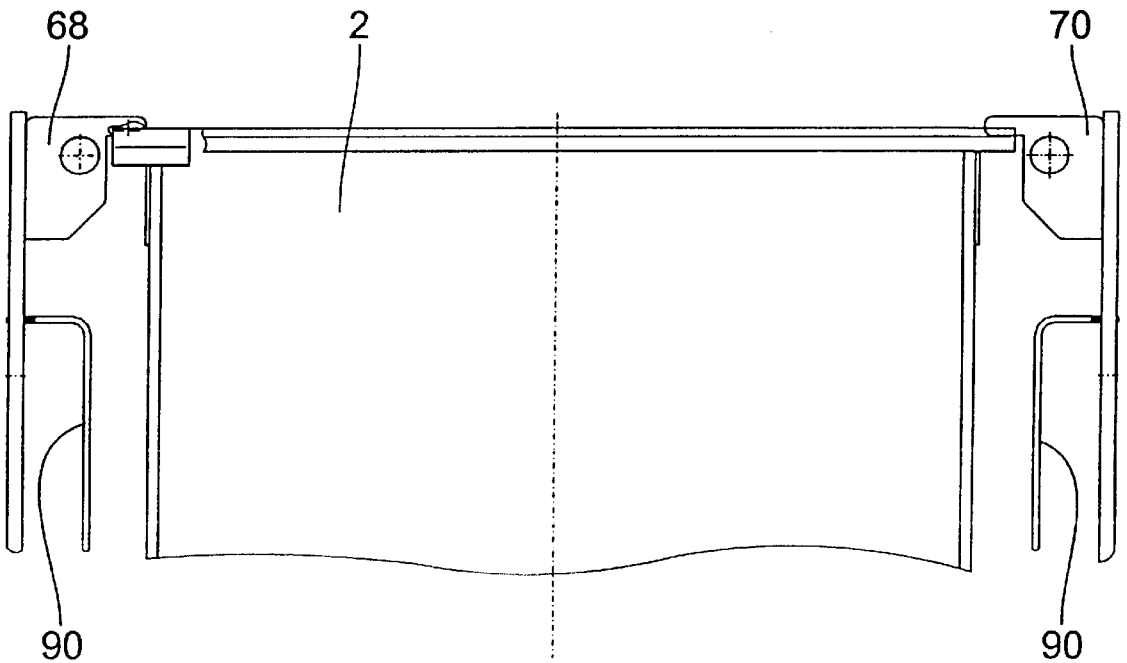
FIG. 7*b* is an enlarged view of a detail of the container guiding arrangement within the dot-dash line circle E' shown in FIG. 2.
Figure 7A:
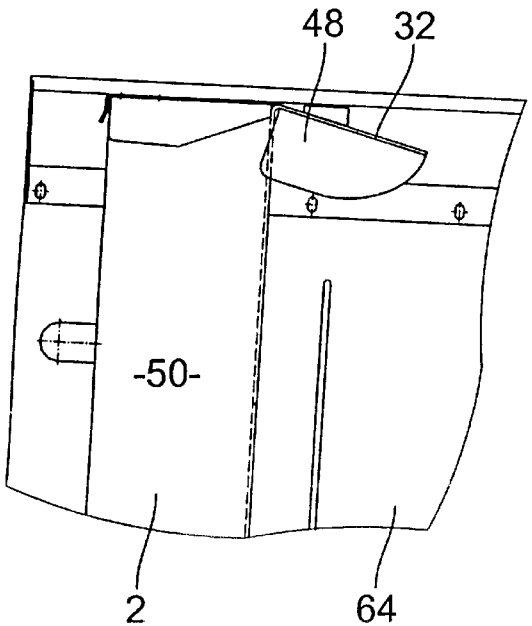
FIG. 7*a* is an enlarged view of a detail, namely of a container guiding arrangement, within the dot-dash line circle E shown in FIG. 1.

The container 2 must be opened not later than when it arrives at the upper level, i.e., before it is caused to change its orientation and to dump its contents into the magazine 74. In the apparatus 1 of FIGS. 1 and 2, successive filled containers (2', 2, 2*a*, 2*b*, 2*c*, 2*d*, etc.) are opened not later than upon entry into the receptacle 22 of the elevator 14. The means for opening filled and closed containers at the lower level of the receptacle 22 includes a suction-operated opening device 34 having means for pivoting the cover or top (hereinafter called cover) 32 of the filled container 2 relative to the upright sidewall 2A of such container. The relevant parts of the opening device 34 are shown in FIGS. 5*a* and 5*b* in views respectively corresponding to those of FIGS. 1 and 2 Such parts include suction cups 36 which are pivotable toward the upper side of the cover 32 of the closed container (2) in the receptacle 22, and thereupon with the cover above and away from three (2B, 2C, 2D) of the four sidewalls 2A–2D of such container. The horizontal axis about which the cover 32 in the receptacle 22 is pivotable is shown at 38. When such pivoting or opening step is completed, the cover 32 has been pivoted through an angle of close to or exactly 180° and occupies the position 40 shown by dotted lines in FIG. 5*a*.

FIG. 5*a* further shows that the cover 32 is (temporarily) maintained in the open position 40 by a holding device 44. This device is preferably resilient; it can be made of a suitable metallic sheet material and includes end portions 42 provided with projections 46. The device 44 yields when it is struck by the cover 32 while the latter pivots toward the open position 40, and the device 44 thereupon recoils and causes its projections 46 to maintain the cover in the position 40. FIG. 5*b* shows that the holding device 44 comprises two halves which are or can be mirror images of each other.

The cover 32 of each of the illustrated containers comprises two pivotable flaps 48 which overlie the inner or the outer sides of the upper end portions of the adjacent sidewalls 2C, 2D of the respective container. When a cover 32 assumes the open position 40 of FIG. 5*a*, the flaps 48 at first extend upwardly above the cover (this is shown by dotted lines, as at 52). Once the cover 32 is engaged by the projections 46 of the resilient holding device 44, the flaps 48 are caused to pivot relative to the cover toward positions located below the plane of the cover; such pivoting is carried out by levers 54 one of which is shown in each of FIGS. 5*a* and 5*b*. Each of these levers has a substantially pin-shaped projection or extension 56 (one shown in each of FIGS. 5*a* and 5*b*) which engages the adjacent upwardly extending flap 48 (in the position 52). The lever 54 is pivotable about the horizontal axis of a pivot member 58 which is mounted in a plate-like support 60. Several intermediate positions 62 of the flap 48 shown in FIG. 5*b* are indicated by broken lines. The pivoting of the flaps 48 by the respective levers 54 is a passive pivoting action, i.e., the flaps move relative to the respective levers.

Once the cover 32 of the container 2 in the receptacle 22 of the elevator 14 reaches the open position 40 and the pivoting of each flap 48 to the position below the plane of the open-position cover is completed, the motor of the elevator 14 is set in motion to lift the container from the level of the upper reaches of the belts 10*b*, 10*c* to the level of the container 2' shown in FIGS. 1 and 2. The container 2' is about to dump or has already dumped its contents into the magazine 74. The means for emptying successive containers 2, 2*a*, 2*b*, 2*c*, 2*d*, etch, once they reach the level of the container 2' shown in FIGS. 1 and 2, includes a frame-like tilting or pivoting or inverting device 64 (see also FIGS. 6*a*, 6*b* and 7*a*, 7*b*) which turns the filled but already opened container upside down by pivoting it about a horizontal axis through an angle of 180° or thereabout. This causes the open cover 32 of the container to move from a level above to a level below the contents of the opened container so that such contents can be evacuated (dumped) by gravity flow.

The illustrated emptying device 64 comprises suitably configurated (such as L-shaped) brackets 66 (see FIGS. 6*a* and 6*b*) which engage and hold the container (such as 2') during pivoting from the receptacle 22 to a level above the magazine 74, i.e., during a change of orientation of the container 2' from a first orientation in the receptacle 22 to a second orientation (as shown at 102') in which the contents of such container are admitted into the magazine 74. The brackets 66 preferably further serve as a means for causing the fully emptied container 2' to reassume its first orientation in which it is ready to be transported along a second horizontal or nearly horizontal path at a level above the predetermined path defined by the upper reaches of the belts 10*b*, 10*c*.

FIG. 2 shows lateral guides 90 which prevent the flaps 48 from leaving the positions imposed by the respective levers 54. The arrangement is or can be such that the flaps 48 bear against the adjacent sides of the respective guides 90 while the freshly opened container 2 moves with the receptacle 22 and the arm 30 of the elevator 14 from the solid-line position shown in FIGS. 1 and 2 to the location taken up by the container 2' in the upper portions of FIGS. 1 and 2. Thus, the pivotable levers 54 for the flaps 48 can remain at the level shown in FIGS. 5*a* and 5*b*.

The pivotable emptying device 64 comprises retaining members 68, 70 (shown in FIGS. 2 and 7*b*) which compel the container 2' to share the pivotal movements of the device 64 through 180° or thereabout and to assume the inverted position indicated at 102'. The contents (such as filter rod sections) of the inverted opened container 2' can discharge a mass flow of parallel filter rod sections which are caused to enter the magazine 74 for temporary storage or for admission into the magazine of a tipping machine (such as the aforementioned MAX machine).

Figure 8B:
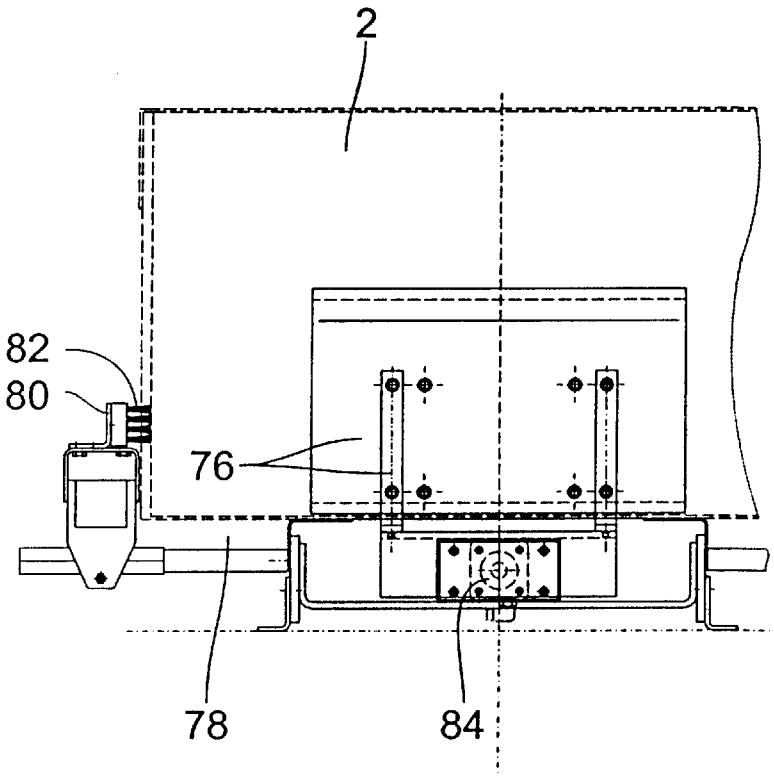
FIG. 8*b* is an enlarged view of a detail of the transporting unit within the closed dot-dash line F' shown in FIG. 2.
Figure 8A:
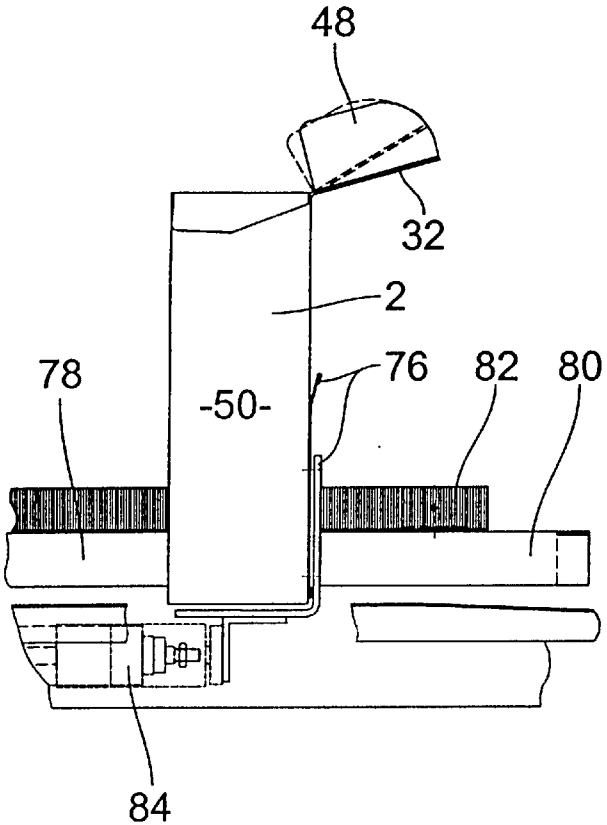
FIG. 8*a* is an enlarged view of a detail, namely a transporting unit for emptied containers, within the dot-dash line circle F shown in FIG. 7.

The device 64 restores the orientation of the freshly emptied container (such as 2'), and such container is thereupon taken over by one or more pushers of the transporting means 76 (see also FIGS. 8*a* and 8*b*) The transporting means 76 removes (e.g., expels) the freshly emptied and reoriented container (see the container 2" shown in FIGS. 1 and 2) from the device 64 and advances it along the aforementioned second path (indicated in FIG. 1 by the reference character 78) to a dump, to a recycling station or to a refilling station, not shown. The container 2" advancing along the path 78 is prevented from changing its orientation by a device 80 which comprises brakes 82 (such as brushes) which flank the second path and engage the respective lateral sidewalls 2C, 2D of the emptied and reoriented container 2".

The means for operating the mobile parts of the device 80 (i.e., for manipulating the brakes or brushes 82) preferably includes one or more prime movers 84, e.g., hydraulic motors. The brakes or brushes 82 counteract the tendency of the emptied container 2" to lie flat upon one of its sidewalls 2A,2B, subsequent to movement beyond the emptying device 64, due to a change in the locus of the center of gravity of the emptied container.

The apparatus 1 further comprises a suitable control unit (schematically shown in FIG. 1 as at 100) which repeatedly and automatically initiates the movements of various mobile parts in a predetermined sequence to ensure that successive containers 2, 2*a*, 2*b*, 2*c*, 2*d*, etc. of the series of such containers are singularized, opened, lifted, emptied, caused to reassume their orientation and transported away at preselected or required intervals. Such control unit receives signals from the sensor 25 and several additional sensors, not shown, and processes such signals in any known suitable manner to ensure that the machine or machines receiving commodities from the magazine 74 can be operated at the required speed.

It is clear that the operation of the improved apparatus 1 is not limited to the manipulation of containers for filter rod sections or other rod-shaped articles of the tobacco processing industry but that the apparatus can be put to use in connection with automatic manipulation of containers for many other types of commodities. The same holds true for the improved method.

The elevator 14 can be designed to operate with a single receptacle 22 which is movable up and down between the levels shown in FIGS. 1 and 2, or with two or more receptacles which are movable unidirectionally along an endless path having an upright or upwardly sloping stretch along which successive filled receptacles 22 move from the lower level of the upper reaches of the belts 10*b*, 10*c* to the upper level of the container 2' shown in FIGS. 1 and 2.

Though it is presently preferred to employ pneumatic (suction-operated) means (24) for singularizing and pneumatic (suction-operated) means (34) for opening successive filled containers 2, 2*a*, 2*b*, 2*c*, 2*d*, etc., at least one of the means 24, 34 can be replaced with other suitable (such as mechanical, hydraulically operated or other) devices for carrying out the respective (singularizing and/or container opening) steps. All that counts is to ensure that the improved apparatus can be utilized to carry out the above outlined series of steps, operations and other manipulations with substantial savings in personnel and in a highly reliable and space-saving manner to satisfy the needs of the processing machine or machines with a heretofore unmatched degree of reliability.

Applicants believe that they are entitled to patent protection for the entire apparatus 1 and its equivalents, for the entire method involving the steps starting with the delivery of a series of successive filled containers by the advancing means including the conveyor 10 and ending with evacuation of emptied containers (such as 2") by the transporting means 76, as well as for several subcombinations of elements and steps. For example, the combination of advancing means which includes the conveyor 10, of pneumatic singularizing means 24 and of pneumatic opening means 34 is believed to constitute a patentable innovation of high order. The same is believed to apply for the combination of the opening means 34, elevator 14 and emptying means 64, as well as for other combinations of parts which together constitute the described and illustrated apparatus 1.

Still further, it is within the spirit and scope of the present invention to employ modified opening means (in lieu of the opening means 34) if the apparatus is called upon to automatically manipulate containers which differ from the illustrated containers 2, 2*a*, 2*b*, 2*c*, 2*d*, etc. in the number, positions, configurations and/or other details of the covers, in the extent to which the orientations of opened containers must be changed in order to dump or to otherwise evacuate the contents of the opened containers, and so forth.

The provision of means (such as 34 or an equivalent thereof) for and of the step of opening the filled containers in a manner other than manually or partly manually has been found to constitute one of highly desirable, important and advantageous (such as time-saving) features of the improved method and apparatus.

The pivoting of the covers 32 of the illustrated containers 2 to 2*d*, etc. through angles of close to or exactly 180° also constitutes a desirable feature of the improved method and apparatus; this ensures that the outlet at the top of a filled container (i.e., at a level above the contents of such container) is unobstructed when the container is turned upside down so that the contents of the inverted container can be evacuated in a predictable and reproducible manner. The just described pivoting of the covers 32 through angles at least approximating 180° is even more important and desirable if the apparatus is equipped with means (such as pivotable implements called swords) for at least temporarily reclosing or resealing the openings of the containers, i.e., subsequent to completion of the evacuating or emptying step.

The resilient holding device or devices 44 is or are or can be installed to move with the receptacle 22 up and down. However, and if the apparatus 1 is equipped with guide means (90) which is capable of ensuring that the opened cover 32 of the filled container (such as 2) remains in the required open position 40, the holding device(s) 44 can remain at the level adjacent the upper reaches of the belts 10*b*, 10*c*. It is clear that the purely mechanical holding device(s) can be replaced by or utilized jointly with one or more suction-operated or other suitable holding devices.

The flaps 48 are optional, depending upon the nature of commodities in the containers, upon the extent to which the openings of the containers must be closed or sealed prior to evacuation of their contents, upon the dimensions and configuration of the sidewalls (such as 2A to 2D) and/or upon other parameters Such flaps are often desirable when the containers are made of cardboard or the like. The extent to which the flaps 48 must be pivoted relative to the respective covers 32 also depends upon one or more factors such as the number and the dimensions of the flaps, the availability of space for the pivoting of the flaps at the lower or upper level of the receptacle 22, and other factors. The flaps 48 of the illustrated covers 32 are pivotable (relative to the respective covers) through angles at least approximating 180°. Such pivoting can take place as soon as the cover is pivoted (relative to the upper portion of the respective sidewall 2A) through an angle which suffices to ensure that its flaps 48 can pivot without being interfered with by the upper portions of the respective sidewalls 2C and 2D.

A pivoting of the flaps 48 relative to the respective cover 32 through 180° or thereabout is desirable when the improved apparatus 1 employs the aforementioned sword-like implement(s) for at least temporarily closing the openings of containers (such as 2') upon completion of the emptying step. The displacing lever or levers 52 can be designed (such as dimensioned) and mounted in such a way that it or they can pivot at least one flap 48 away from the upper end portions of the sidewalls 2B, 2C, 2D, i.e., away from the major part of the respective freshly opened container. Each lever 52 can constitute an active or a passive displacing means, i.e., each such lever can be positively moved by a motor or the like to move against and to pivot the respective flap(s) 48, or each such lever can remain stationary in a position in which it automatically pivots the oncoming and bypassing flap(s) 48 while the freshly opened container moves from the level of the upper reaches of the belts 10*b*, 10*c* to the level of the container 2' shown in FIGS. 1 and 2.

The apparatus 1 can be provided with a single guide 90 or with several such guides, depending upon the number of flaps 48 which should be maintained in predetermined positions during lifting of freshly opened containers with the single receptacle 22 or with one of several receptacles of the elevator 14. The illustrated apparatus 1 is designed to manipulate containers with covers (such as 32) each of which comprises two flaps (48) overlapped by the respective sidewalls (2C, 2D) in the closed position of the respective cover. The guides 90 can be designed to ensure that the extent of pivotal movement imparted to the flaps 48 by the respective levers 54 remains unchanged, or that such extent is caused or permitted to change (increase or decrease) during upward movement of a freshly opened container with the receptacle 22 (or with one of the receptacles) of the elevator 14.

The provision of brakes in the form of brushes 82 or the like is especially desirable and advisable if the freshly emptied containers (such as the container 2") should reach the next station (e.g., a refilling station) in a predetermined orientation, e.g., with the cover 32 open as shown in FIG. 1 at the level above the still filled and closed container 2*b*.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of methods of and apparatus for automatically opening and emptying boxes and other types of containers for arrays of cigarettes and other types of commodities and, therefore, such adaptations should and are intended to be comprehended within the meaning and range of equivalence of the appended claims.

What is claimed is:

1. A method of automatically manipulating closed-top filled containers for smokers' products, the containers being of the type having upright sidewalls and a cover connected to one of the sidewalls and pivotable between closed and open positions and flaps connected with and movable between first positions inwardly adjacent to additional sidewalls in the closed position of the cover and second positions upon pivoting of the cover to the open position, the method comprising the steps of:

opening the top of a container by pivoting the cover from the closed to the open position and thereupon moving the flaps relative to the cover;

thereupon moving the container from a first level to a different second level; and thereupon causing the container to change its orientation from a first orientation in which the products are located below the opened top to a second orientation in which the products are evacuated through the opened top by gravity flow.

2. The method of claim 1, wherein the smokers' products are rod-shaped products.

3. The method of claim 1, wherein said moving step includes moving the container from a lower level to a higher level.

4. The method of claim 1, wherein said orientation changing step includes turning the container upside down.

5. The method of claim 1, further comprising the steps of causing the container to reassume the first orientation and thereupon advancing the container along a predetermined path.

6. The method of claim 5, further comprising the step of preventing the container from changing its orientation in the course of said advancing step.

7. The method of claim 5, wherein said reassuming step includes causing the emptied container to pivot through an angle of at least close to 180°.

8. The method of claim 1, wherein the flaps are pivotable relative to the cover and said step of moving the flaps include pivoting the flaps relative to the cover through angles at least approximating 180°.

9. Apparatus for automatically manipulating initially closed containers for smokers' products, the containers being of the type having sidewalls and a cover pivotable to one of the sidewalls, the cover having pivotable flaps engaging additional sidewalls prior to opening of the respective containers, the flaps of the cover assuming said open positions being disengaged from the respective additional sidewalls in response to pivoting of the covers to open positions, the apparatus comprising:

means for advancing a series of successive closed and filled containers in a predetermined direction along a predetermined path;

means for opening successive containers of the series in a predetermined portion of said path, the opening means including at least one suction generating device having means for pivoting the cover of the container in said predetermined portion of said path relative to the one sidewall to an open position; and displacing means for moving at least one flap of the cover assuming said open position in said predetermined portion of said path relative to the respective cover.

10. The apparatus of claim 9, further comprising means for temporarily holding the cover of the container occupying said predetermined portion of said path in said open position.

11. The apparatus of claim 10, wherein said holding means includes a resilient metallic member.

12. The apparatus of claim 9, wherein said displacing means includes means for pivoting the at least one flap relative to the respective cover away from the sidewalls of the container in said predetermined portion of said path.

13. The apparatus of claim 9, wherein said advancing means comprises a conveyor for successive containers of the series, means for maintaining the containers of the series in said path, and means for separating successive foremost containers from the next-following containers in a second portion of said path upstream of said predetermined portion.

14. The apparatus of claim 13, wherein said separating means comprises suction-operated means for temporarily arresting successive next-following containers in said second portion of said path while the conveyor advances the foremost container into said predetermined portion of said path.

15. The apparatus of claim 9, further comprising an elevator having at least one receptacle movable between a first level at which the at least one receptacle at least partially confines the container occupying said predetermined portion of said path and a different second level subsequent to opening of the container in said predetermined portion of said path.

16. The apparatus of claim 15, wherein said second level is disposed above said first level.

17. The apparatus of claim 15, further comprising emptying means for changing the orientation of the opened container at said second level from a first orientation in which the opened container confines the products therein to a second orientation in which the container dumps its contents by gravity flow.

18. The apparatus of claim 17, further comprising means for restoring the first orientation of emptied containers and means for thereupon transporting emptied containers along a second path.

19. The apparatus of claim 18, further comprising means for preventing appreciable changes in orientation of emptied containers in said second path.

20. The apparatus of claim 19, wherein said preventing means includes at least one brake.

21. The apparatus of claim 20, wherein said at least one brake includes at least one brush frictionally engaging emptied containers in said second path.

22. The apparatus of claim 15, wherein said means for opening is arranged to open the container occupying said predetermined portion of said path subsequent to confinement of the container in said at least one receptacle.

23. The apparatus of claim 15, further comprising guide means for the container which is confined in said at least one receptacle, said guide means being operative to maintain the container within said at least one receptacle in a predetermined position during movement of said at least one receptacle from said first level to said second level.

* * * * *